US008336276B2

(12) United States Patent
Tikhovskiy

(10) Patent No.: US 8,336,276 B2
(45) **Date of Patent: *Dec. 25, 2012**

(54) MODULAR CONSTRUCTION SYSTEM AND COMPONENTS AND METHOD

(76) Inventor: Nikolay P Tikhovskiy, Maple (CA)

( * ) Notice: Subject to any disclaimer, the term of this patent is extended or adjusted under 35 U.S.C. 154(b) by 49 days.

This patent is subject to a terminal disclaimer.

(21) Appl. No.: 13/064,826

(22) Filed: Apr. 19, 2011

(65) Prior Publication Data

US 2012/0167502 A1 Jul. 5, 2012

Related U.S. Application Data

(63) Continuation-in-part of application No. 12/929,091, filed on Dec. 30, 2010.

(51) Int. Cl.
*E04B 5/18* (2006.01)

(52) U.S. Cl. ..... 52/742.14; 52/251; 52/236.8; 52/236.9; 52/260

(58) Field of Classification Search ..... None
See application file for complete search history.

(56) References Cited

U.S. PATENT DOCUMENTS 4,328,651 A * 5/1982 Gutierrez ..... 52/293.1
4,550,536 A * 11/1985 Lamoure ..... 52/91.2
2007/0193213 A1* 8/2007 Nanayakkara ..... 52/750

* cited by examiner

*Primary Examiner* — Basil Katcheves
*Assistant Examiner* — Beth Stephan

(57) ABSTRACT

A modular construction system and having a plurality of precast concrete caissons, and having a planar floor portion formed on each caisson, downwardly dependent caisson walls surrounding the floor portion, inward and outwardly directed wall surfaces on the caisson walls, with the floor portion and the inward surfaces of the walls together defining a downwardly open hollow space, rebars embedded in the caisson floor portion and in the caisson walls, and, precast concrete locking formations formed on the outwardly directed surfaces of the walls. Also disclosed is a method of precasting caissons, and a method of building construction using precast caisson, and poured in place beams and precast wall panels and poured in place frames.

11 Claims, 21 Drawing Sheets

MODULAR CONSTRUCTION SYSTEM AND COMPONENTS AND METHOD

This application is a Continuation in Part of U.S. application Ser. No. 12/929,091 filed Dec. 30, 2010. Title MODULAR CONSTRUCTION SYSTEM AND COMPONENTS AND METHOD, inventor Nikolay P. Tikhovskiy.

FIELD OF THE INVENTION

The Invention relates to a modular construction system utilizing precast concrete caisson components, and connecting beams formed of poured-in-place concrete, and to caisson components having planar floor portions and surrounding dependent walls, enclosing an inverted hollow space, and to a building system using such components and incorporating wall panels and integral vertical frames, and a method of construction utilizing these features.

BACKGROUND OF THE INVENTION

The construction of buildings formed of poured-in-place concrete and with exterior walls of concrete panels, has been in use for many years. Conventional techniques involve the use of, in general, first of all pouring concrete columns, internally reinforced with rebars, then erecting horizontal form work for pouring a floor slab, and then pouring an entire floor of concrete in situ on the form work at the building site. Usually the construction proceeds by pouring further columns and then pouring floors in situ, to reach the appropriate height of the building. Exterior walls are often erected of precast concrete panels.

Such systems are labour intensive, and slow and expensive. The systems are also wasteful of materials such as form work, and wasteful of concrete and rebars. The form work is usually custom made on site and erected on a large number of internal portable posts. The form work must be laid out and supported accurately so that the pouring of the floor can proceed. The resulting floors are poured in one piece in the majority of cases. Rebars are incorporated throughout such a floor, and the floor is connected to the upper ends of the vertical frame s, usually by connecting rebars. The volumes of concrete used in such a system are very considerable. The thickness and weight of the rebars is also considerable. The total weight per floor of the building is therefore made up of relatively massive monolithic slabs of concrete, and large volumes and lengths of heavy rebars. This is wasteful in terms of costs and materials. It also restricts the height of the building since the footings must be designed to carry a certain weight of construction materials when the building is erected and also the occupants of the building and all their equipment.

In addition to all this, the onsite labour costs are considerable. Typically, onsite labour rates will be two or three times the hourly rate paid to employees in the factory. Clearly it is desirable to both reduce the volume of concrete material required and to reduce the weight of the rebars. It is further desirable to reduce the amount of form work which must be erected to support the floors while they are being poured, and cured. It is also desirable to reduce, as far as possible, the onsite labour costs.

It is therefore desirable to manufacture as far as possible, precast concrete floor components in a factory remote from the building site, and transport such precast floor components to the site and erect them in position. It is also desirable to precast other components including the wall panels , and also the vertical building support columns themselves, and transport them to the site . This will greatly reduce the costs of onsite labour , and avoid time spent on erecting formwork, pouring concrete on site , and for curing time , and for removing formwork. It will reduce the time taken to pour concrete on site.

An additional factor is that by manufacturing modular precast components, stress factors can be incorporated in the modular components, which permit considerable reduction in the amount of concrete and rebars required, without any loss of strength to the building.

Clearly by reducing the weight of the volume and the rebars in the building, it is possible to either reduce the building footings or alternatively to build higher, using the same footings.

One modular system is disclosed in Russian patent No. 2376424; Inventor: Nikolay P. Tikhovskiy; Priority Date: Jun. 3, 2008.

The system disclosed in this patent involves a floor made with the use of pre-cast flat solid concrete slabs, with rebar components extending out from the slabs. The slabs are then supported at floor level, leaving channel spaces between them. In this system the on site pouring time and volume of on site concrete required, and the form-work required is greatly reduced, compared with pouring an entire floor.

However, the floor slabs with rebars were still relatively massive.

It is has now been discovered that the plain flat slabs can be replaced with modular precast concrete caissons. The caissons are formed with massive, deep side walls, and a central slab portion of reduced thickness, supported by the side walls. These caissons may be formed in various shapes, typically square or rectangular but may be hexagonal, or even circular or other shapes, to suit the design of the building. The pre cast caissons are then supported in place at the building site, with their side walls spaced apart being supported by removable posts such as are well known in the art. Between the caisson side walls, channel spaces are defined, which are closed off by form work. Rebars are laid in the channel spaces between the caissons. Concrete beams are then poured on site in the channel spaces between the caissons. The concrete bonds with the side walls of the caissons thereby forming concrete beams, interconnecting and supporting the caissons. The caissons and the beams thus form a homogenous floor.

It is particularly advantageous to provide such caissons which have features capable of interlocking directly with the poured concrete of the beams without the need for interlocking rebars.

By this system, the caissons can be manufactured and precast away from the building site at a remote location, in a factory. The caissons can thus be poured under controlled conditions and can be cured under controlled conditions thereby ensuring the maximum performance of the concrete.

As explained above, the caissons are formed with planar floor slab portions, and downwardly dependent side walls surrounding the floor slab portions. The caisson side walls and the floor slab portion define a downwardly open hollow space.

The caisson side walls are deeper than the thickness of the caisson floor slab portions. As a result, when the form work closes off the channel spaces defined between the caisson side walls, the beams, which are formed by pouring concrete in situ in the channels, have a greater depth, than the beams in the aforesaid application.

Depending upon the design of the building , and the incorporation of building services , it may be desirable in some or all areas of the floors, to use flat precast floor panels, supported by poured in place floor beams. In those cases the floor of the building will consist of a large number of modular precast concrete caissons, interconnected with poured-in-place concrete beams, and some other areas of precast floor slabs, interconnected with poured-in-place beams.

In these cases, transverse beams will be poured in place to support the plain flat panels, and the plain flat panels will incorporate rebars, extending out around their edgs for embedment in such beams.

These beams may incorporate transverse openings at appropriate spacings for accommodating passage of services such as plumbing, electrical, and even HVAC, in some cases.

The construction of the exterior walls of the building may use a variety of precast concrete slabs or many other different exterior building finishes. The building interior partition walls are made of precast concrete. Such interior partition walls are constructed of precast concrete wall panels. Such precast concrete wall panels will be erected side by side, with spaces between their edges so that they do not abut directly edge to edge. Such wall panels incorporate rebars which extend outwardly along the edges of the panels. Vertical form work is then erected along the spaces between the edges of adjacent wall panels, and vertical frame rebars are placed in position, and concrete is then poured in place, to form vertically extending frames holding the wall panels in position, and providing support for the building.

BRIEF SUMMARY OF THE INVENTION

With a view to achieving the foregoing advantages the invention provides a modular pre cast concrete construction system and comprising:

a plurality of pre cast concrete floor panels, each panel defining a planar floor portion; lower and upper floor panel edges defined on said panels, and defining panel side walls there between; panel rebars located in said planar floor panels; floor panel edge rebar portions extending outwardly from said floor panel side walls between said upper and lower panel edges: said floor panels being located as a floor in a checker board fashion with floor beam spaces defined between adjacent floor panels, groups of said floor panels being arranged as successive floors one above another spaced vertically apart to define a plurality of floors; poured in place horizontal concrete floor beams formed in said floor beam spaces between adjacent panel side walls and beam portions located beneath said floor panels and supporting adjacent edges of said floorpanels; floor beam rebars located in said floor beam spaces; said poured in place concrete floor beams embedding both said floor beam rebars and said floor panel edge rebar portions extending from said floor panels; a plurality of precast concrete vertical columns, each said vertical column containing rebars and defining upper and lower ends, said vertical columns being arranged on said floor beams one above the other in vertical alignment with one another; junction rebar portions extending from said vertical columns from both said upper and said lower ends; junction rebar sockets formed in said upper and said lower ends of said vertical columns for receiving junction rebar portions from next adjacent vertical columns, in vertical alignment;

a plurality of precast concrete wall panels, each of said wall panels defining wall panel side edge walls and wall panel upper and lower edge walls, and defining a pre determined wall thickness, groups of said wall panels being located along said floor beams on successive said floors and extending from one said floor to a next adjacent said floor;

rebars embedded in said wall panels, and having wall edge rebar portions extending from either side edge wall and from said top wall; said wall panels being located in vertical planes edge to edge with wall frame spaces between said wall panel edges; poured in place concrete wall frames, between adjacent side walls of said wall panels, wall frame rebars located in said poured in place concrete wall frames, embedding said wall frame rebars, and embedding said side edge rebars extending from adjacent said wall panels.

Usefully the lower floor beam portions extend below the floorpanels, and transverse openings are formed across said lower floor beam portions for building services. The wall panels are homogenous solid concrete members and define a predetermined thickness, and the wall frames define a predetermined thickness equal to that of the wall panels themselves.

The invention further provides a modular flooring system having a plurality of caissons arranged spaced apart from one another and having caisson side walls defining channel spaces there between, and beam rebars located along said channel spaces, and poured in place concrete beams formed in said channel spaces surrounding and embedding said beam rebars, said beams defining upper surfaces co planar with said caisson floor surfaces.

The invention further provides such a modular flooring system wherein said poured in place concrete forming said beams fills said channel spaces and embeds said buttresses.

The vertical rebars reinforcing the vertical frame s extend through the floor beams, and overlap into the vertical frame s formed above the floor beams, on each floor.

The invention further provides a method of forming such a modular flooring system including the steps of precasting a plurality of concrete caissons, erecting formwork strips on supports at a work site, supporting said caissons on said form work at said work site, said caissons being spaced apart and defining channel spaces therebetween, placing beam rebars in said channel spaces, pouring concrete in said channel spaces to form poured in place beams between said caissons.

The invention further provides such a method wherein portions of the floor may be formed by plain flat precast concrete panels, and with supporting beams poured in place for supporting such flat panels, such beams having ledge portions on which edges of such panels are supported, and the panels having rebar portions extending out around their edges and the usual rebars extending along the beams all being incorporated in such a poured in place beams.

In this further modifications the poured in place beams may incorporate through passages, extending transversely through such beam, and located beneath the floor slab, thus enabling services to be passed through such beams.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
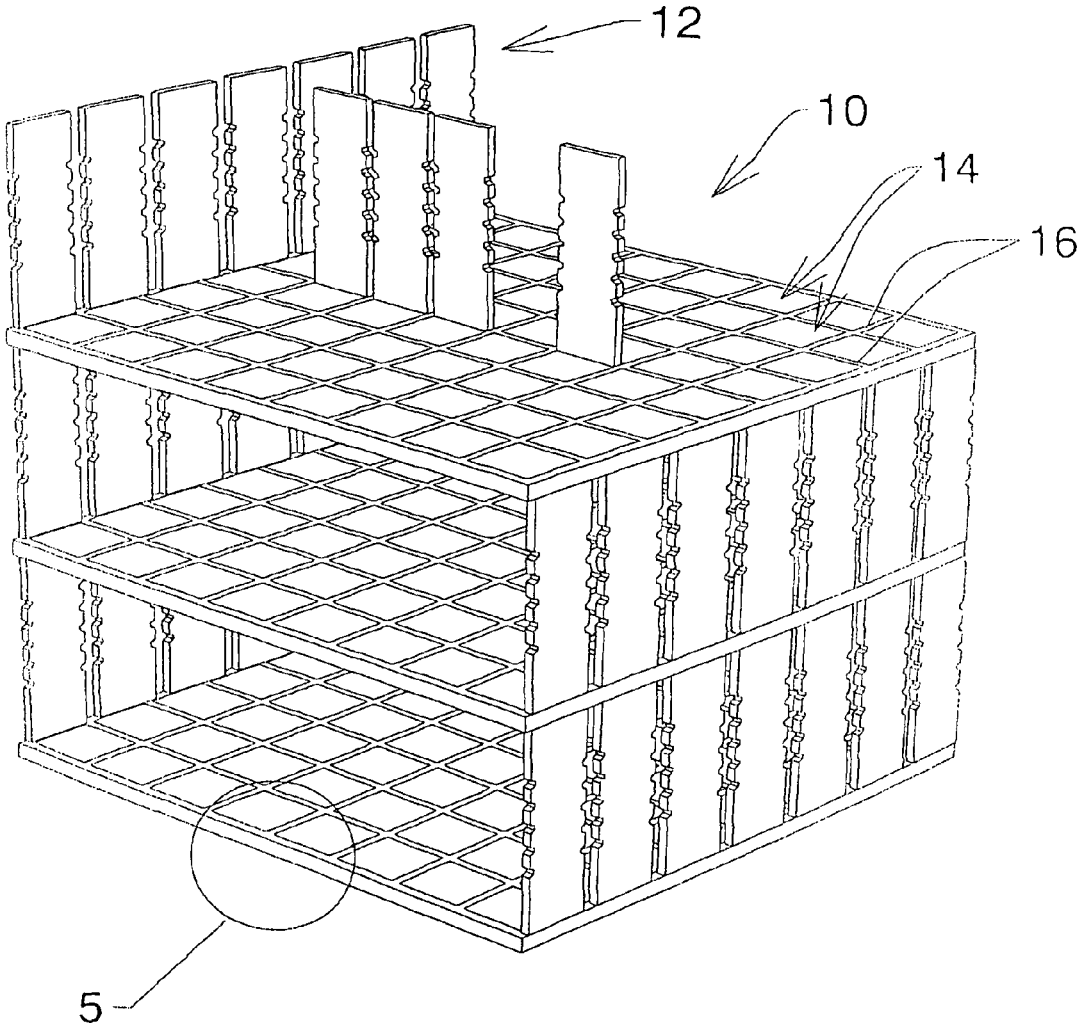
FIG. 1 is a schematic upper perspective illustration of a partially constructed building illustrating the invention.
Figure 2:
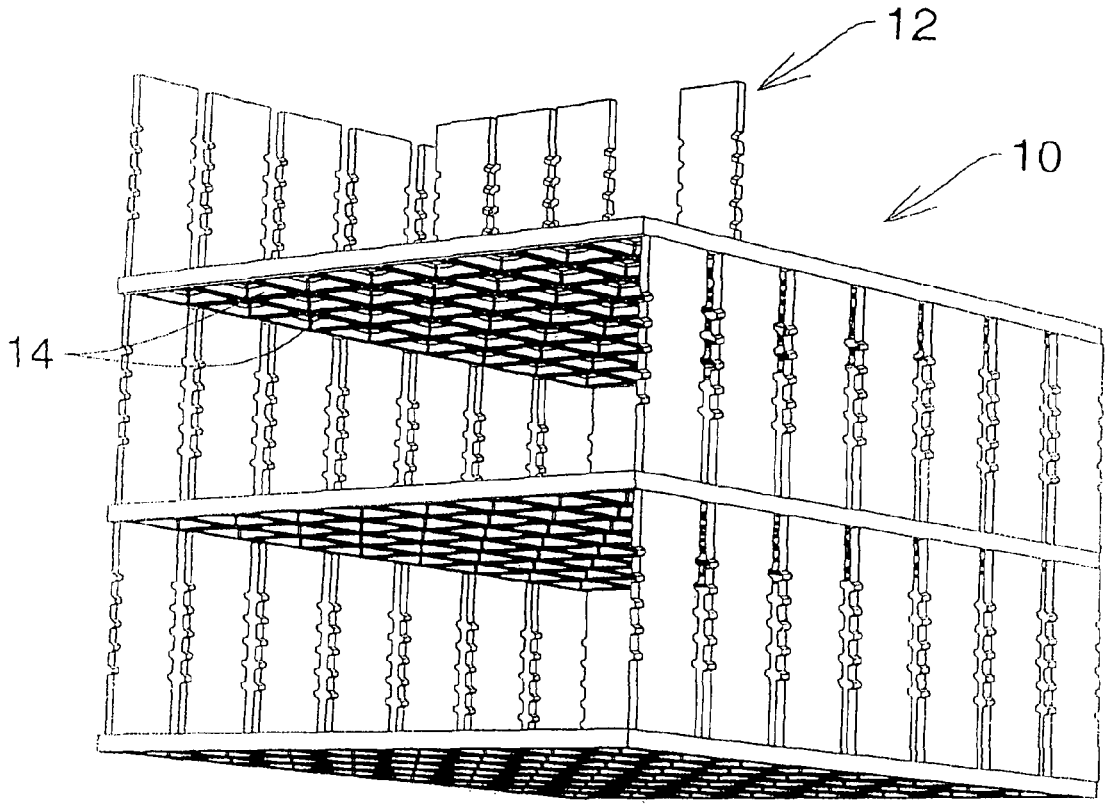
FIG. 2 is a schematic lower perspective illustration of the same building under construction showing the floors from underneath.

As already explained above, the invention relates to a modular construction system, whereby large areas of a building floor can be precast remote from the building site under controlled conditions, and then transported to the site and erected in position to form a floor. As shown in FIGS. 1 and 2, the building, illustrated generally as (10) comprises precast interior walls shown generally as (12), and a floor comprised of a plurality of rectangular modular precast floor caissons (14) and a network of interconnecting poured-in-place beams (16).

Referring to FIG. 1, it will be seen that the caissons (14) have a planar upper floor slab surface (18), so as to provide a level floor. Successive floors will be formed in this way, as shown, one above the other.

Referring to FIG. 2, it will be seen that the caissons (14) comprise a partially enclosed downwardly open chamber (20) on their underside.

Figure 3:
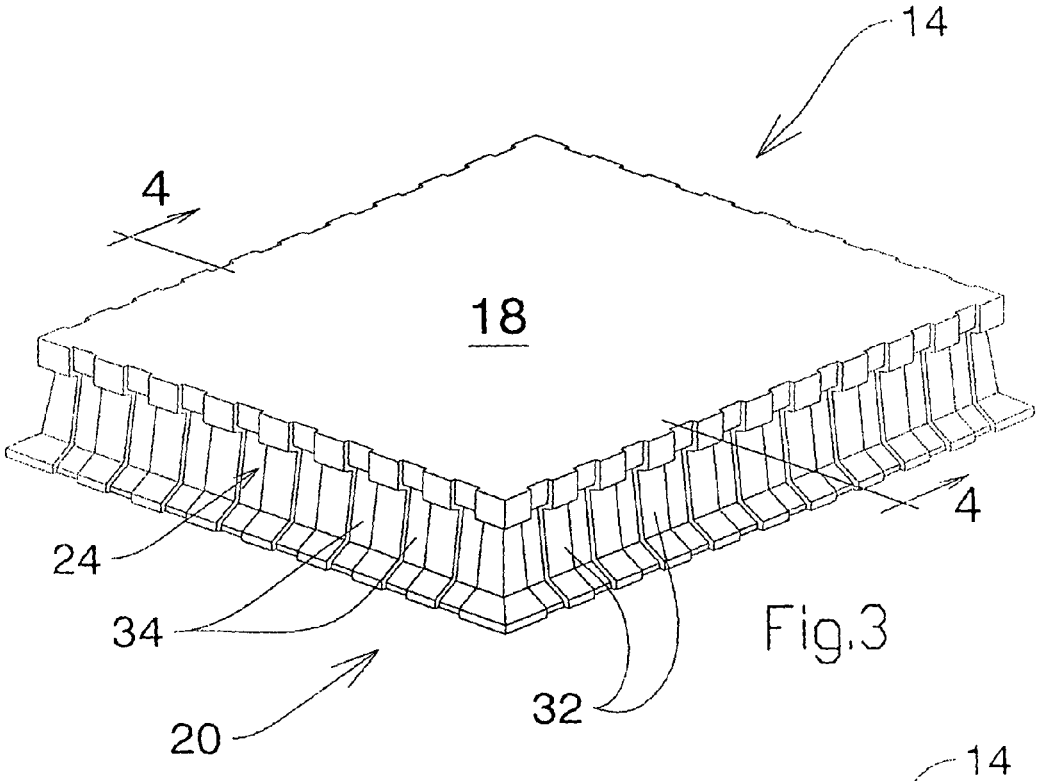
FIG. 3 is a perspective illustration of a typical modular precast concrete caisson illustrating the invention.
Figure 4:
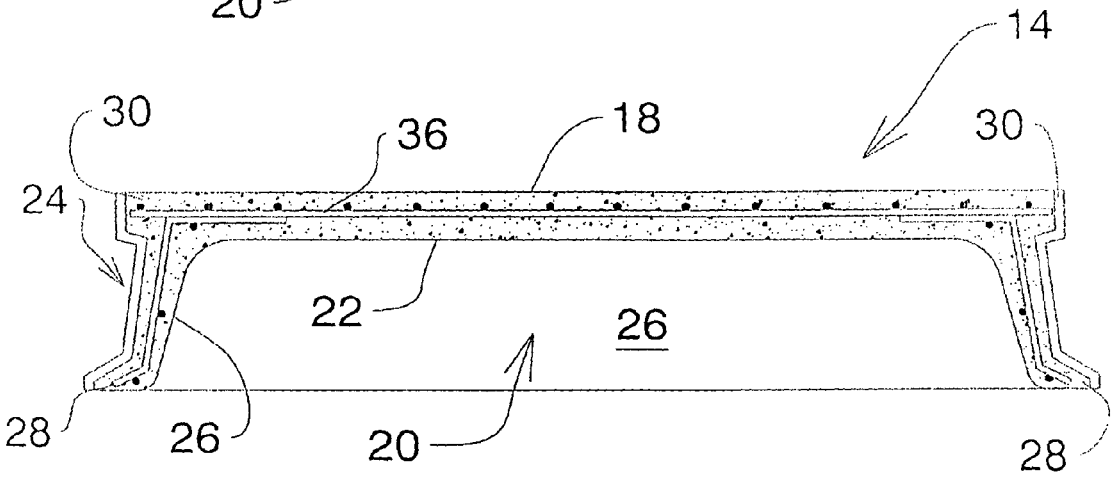
FIG. 4 is a section along the line 4-4 of FIG. 3.

Referring to FIGS. 3 and 4, it will be seen that each of the modular caissons, in this particular embodiment are of square shape in plan, and define on their upper sides planar floor slab surfaces (18), and on their underside, generally planar inward surfaces (22). Around the planar inward surface (22), there are formed, in this case, four downwardly extending caisson side walls (24).

Each of the caisson side walls (24) is formed at an angle displaced from the vertical. The inwardly directed faces (26) of the side walls (24) are smooth. However the outwardly directed faces of the side walls are formed with an outwardly extending lower lip (28), and an outwardly extending upper lip (30). Between the lower and upper lips there are formed a plurality of buttress members (32), defining between them locking recesses or spaces (34).

Referring to FIG. 4 particularly, it will be seen that each of the modular caissons (14) is formed of precast concrete with a network of rebars (36), extending between the upper floor slab surface (18) and the inward face (22), and extending downwardly into the side walls (24).

By means of this construction, caissons (14) can be manufactured with great strength capable of providing support for a much greater load than would normally be possible with a simple slab of concrete of the same size. The caissons of such construction use less concrete than a plain slab of the same size, and they use lighter rebars.

Figure 5:
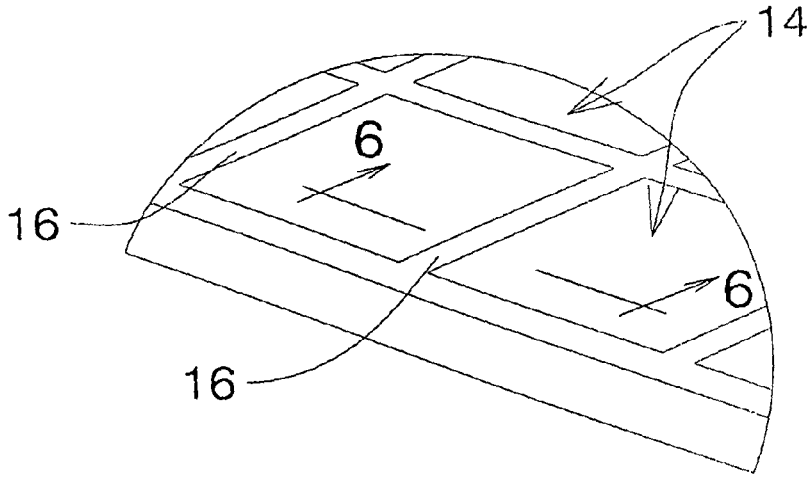
FIG. 5 is a section of the detail of circle 5 of FIG. 1 greatly enlarged illustrating the spacing between the modular precast caissons, prior to the pouring of a beam.

Referring to FIG. 5, it will be seen that the illustration represents the channel spacing (38) between two modular caissons (14), when they are erected prior to the completion of the actual floor of the building. The caisson side walls (24) define channel spaces (36) of V-shaped appearance in section. It will be seen that channel rebars (40) are laid in the channel spacing (38) defined between the two adjacent caisson side walls which form a type of trough, having the shape of a V which is wider at the top and narrower at the bottom. The sides of the trough or channel space (38) are defined by the outer surfaces of the side walls (24) of the two adjacent caissons (14). The trough or channel (38) therefore defines lower lips (28) extending from the adjacent caissons (14) towards each other, and the sides of the V are defined by the plurality of the buttresses (32) and locking spaces (34). Upper lips (30) extend from side walls of the adjacent caissons.

Figure 6:
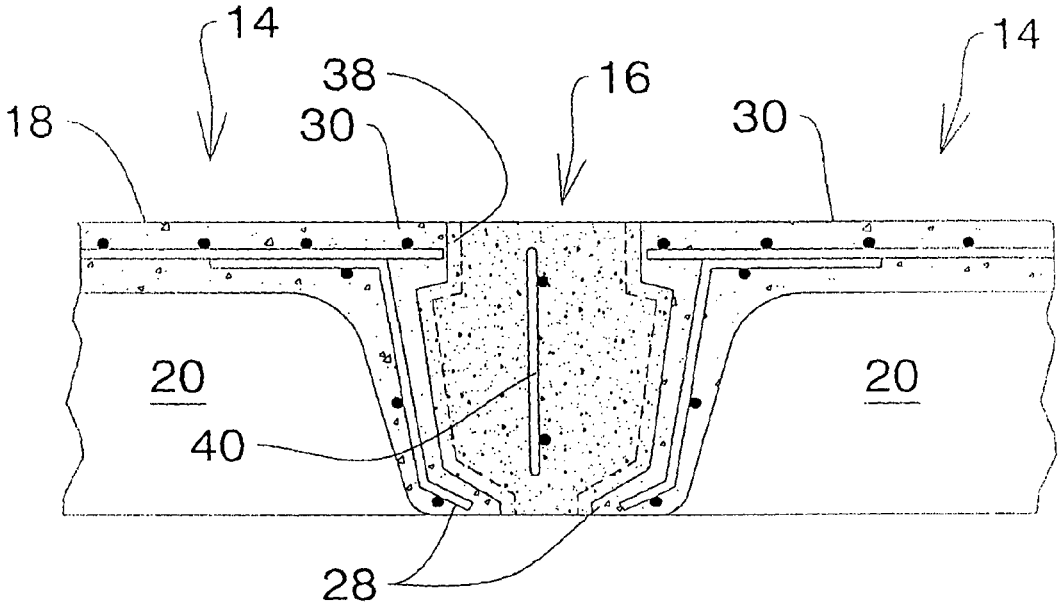
FIG. 6 is a section corresponding to FIG. 5 after pouring the concrete for forming the beam.
Figure 7:
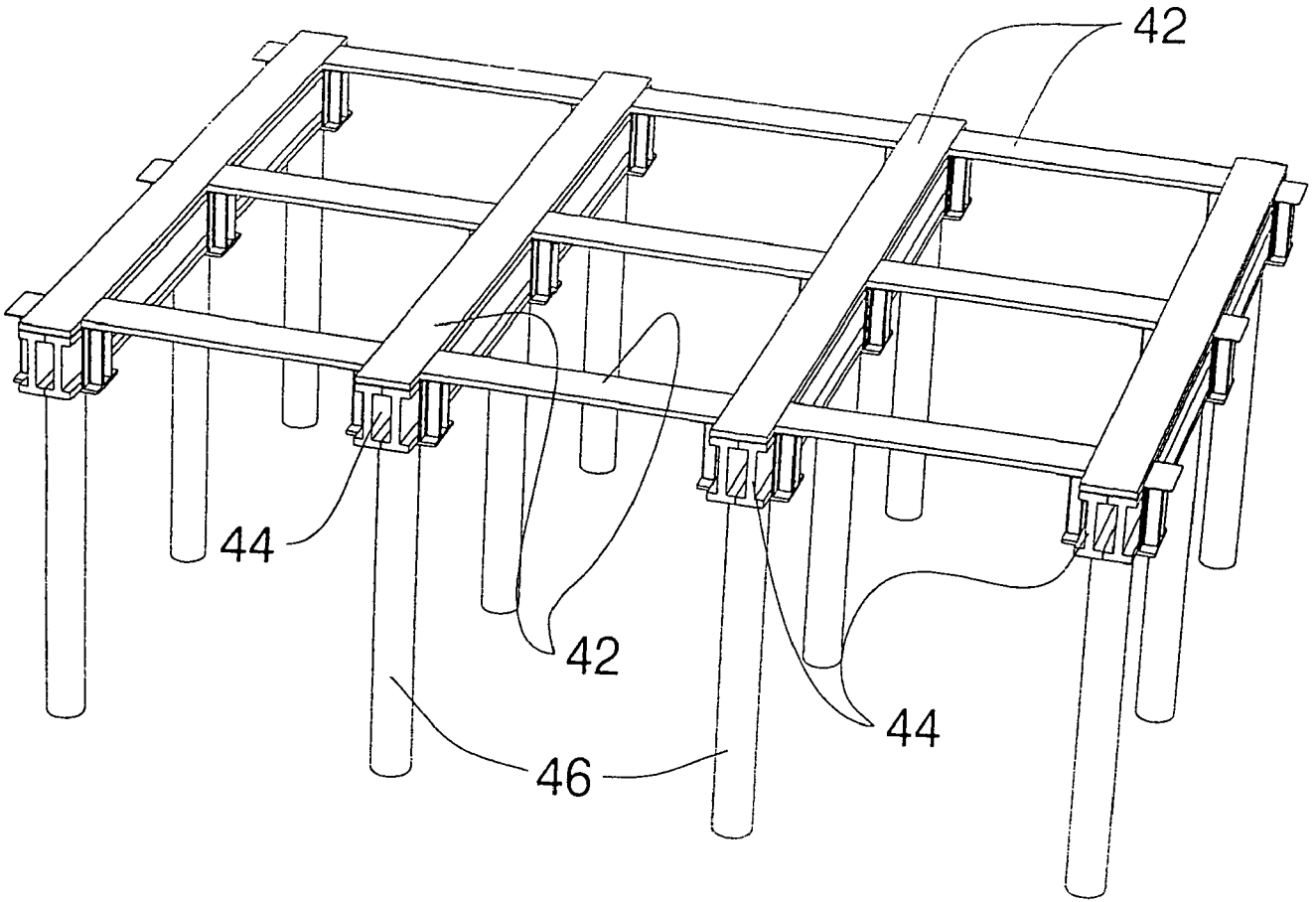
FIG. 7 is a perspective of a first step in erecting a building.
Figure 8:
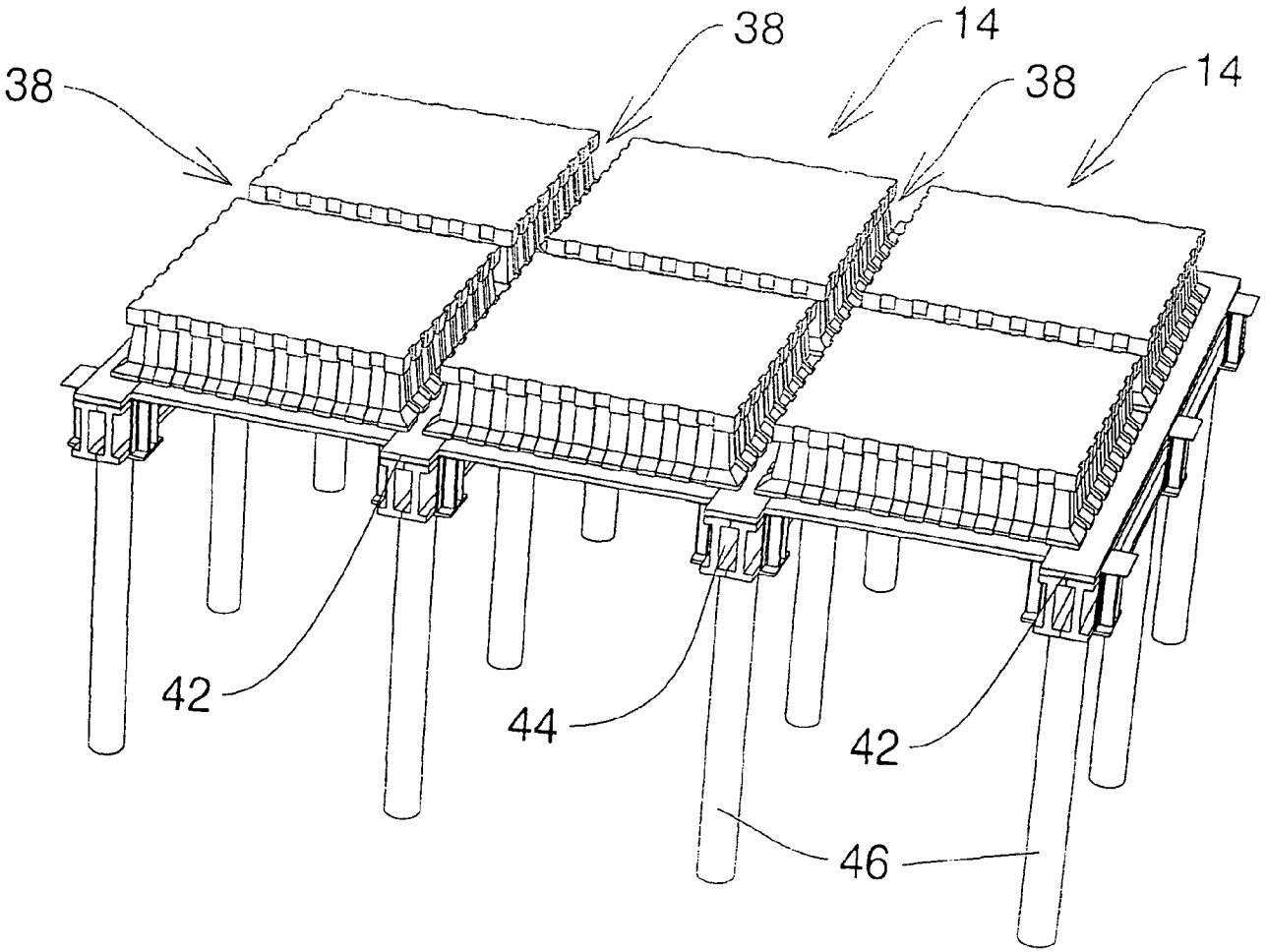
FIG. 8 is a perspective of a second step in erecting a building.
Figure 9:
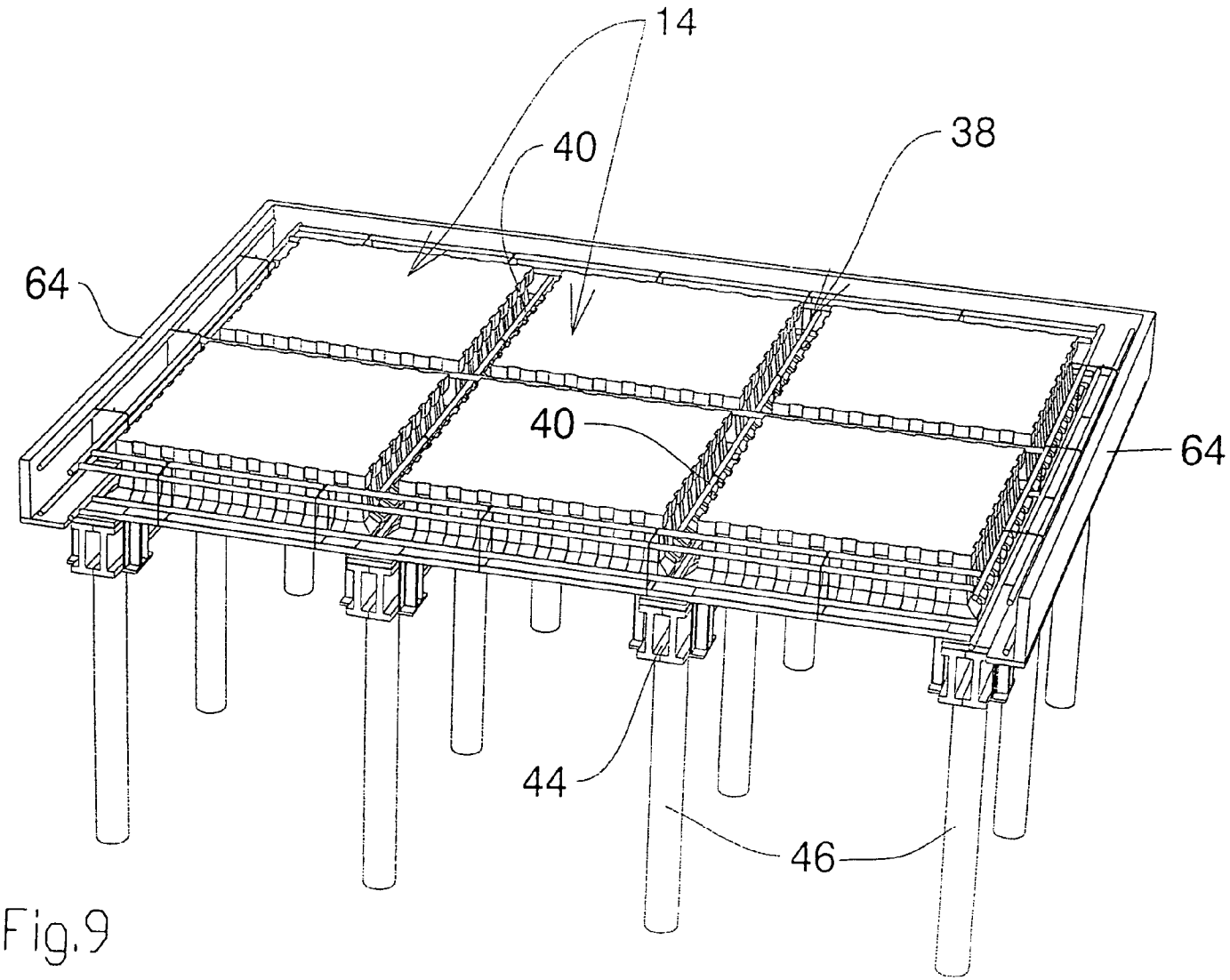
FIG. 9 is a perspective of a third step in erecting a building.
Figure 10:
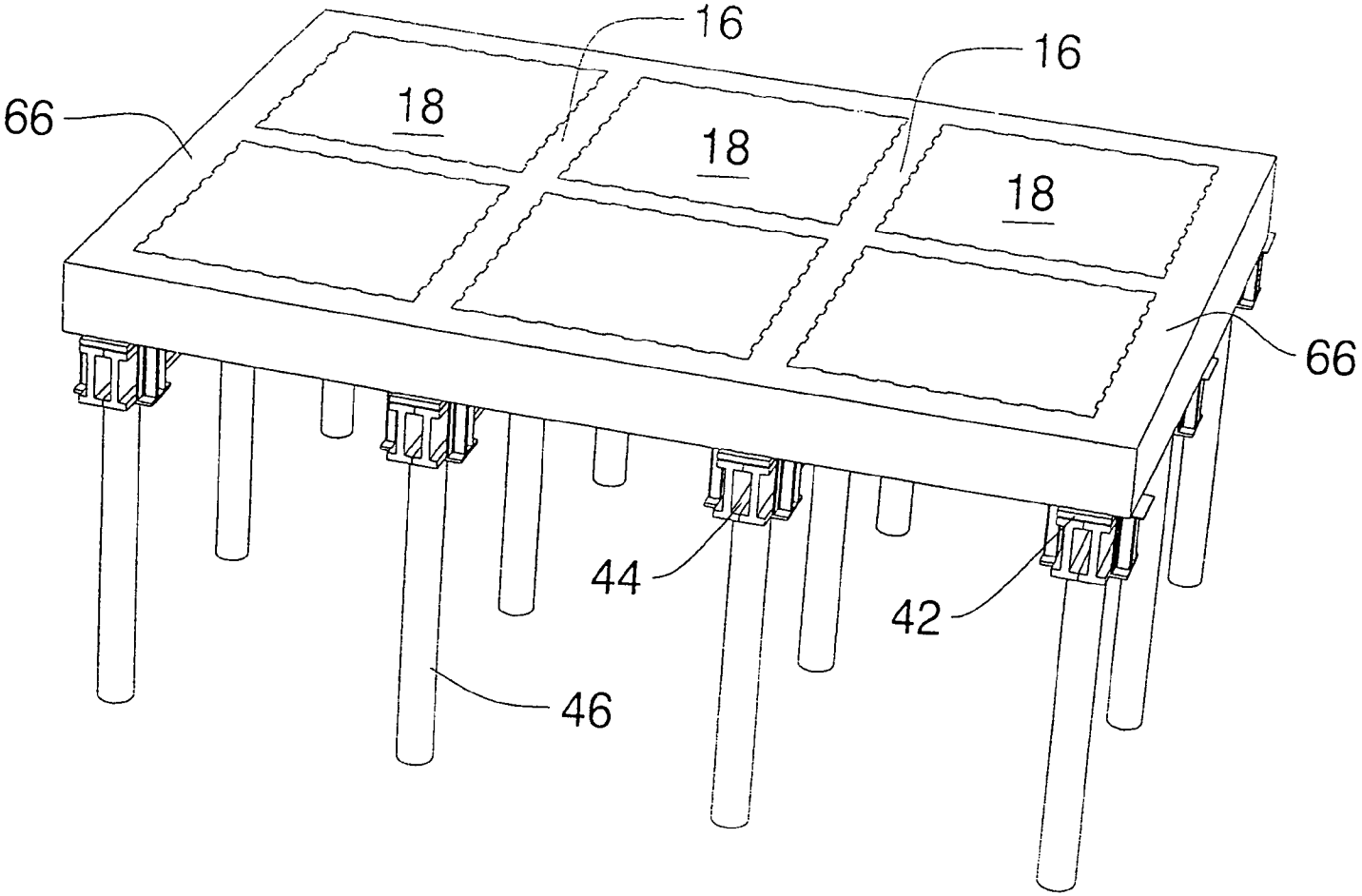
FIG. 10 is a perspective of a fourth step in erecting a building.
Figure 11:
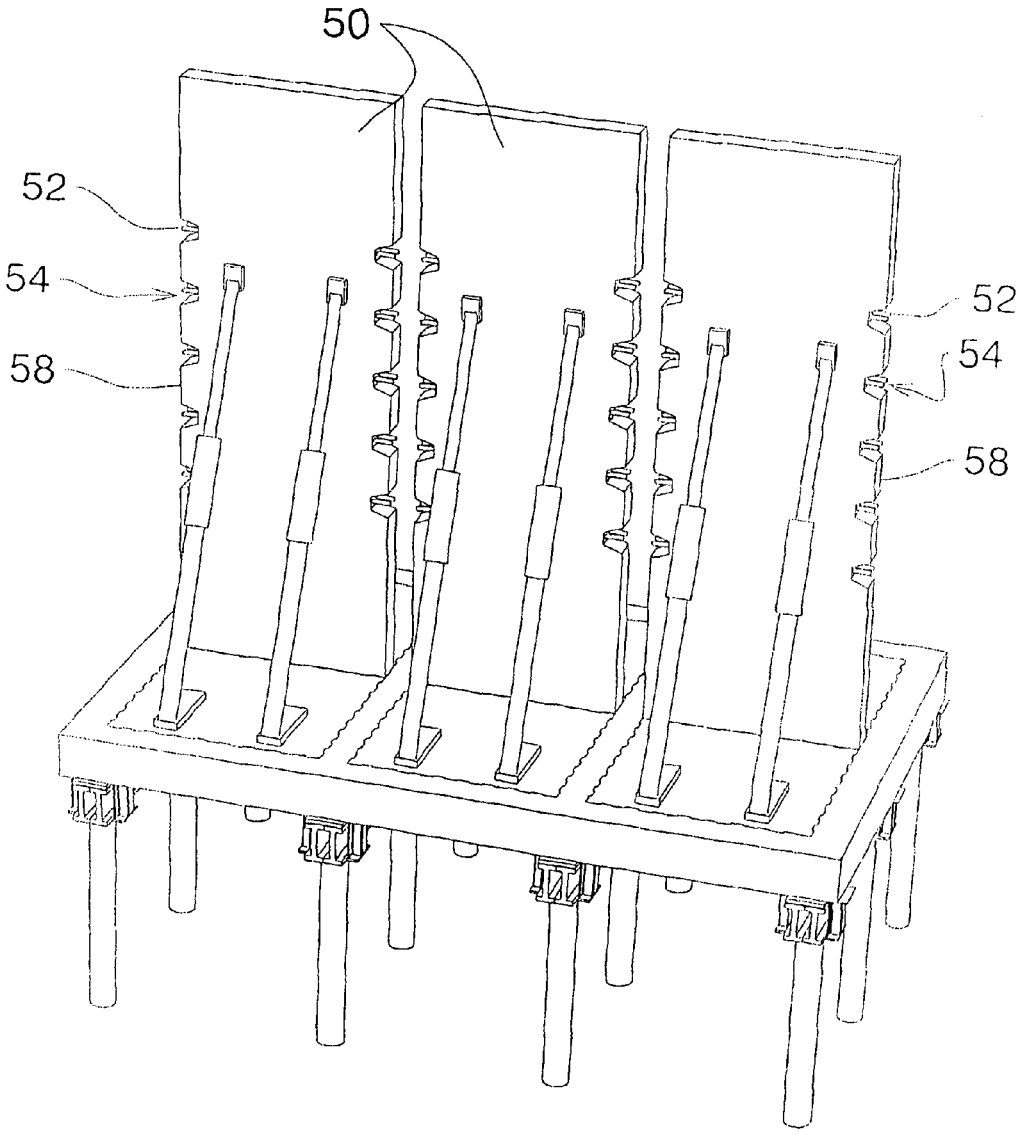
FIG. 11 is a perspective of the wall panels, prior to the pouring of a vertical concrete frame, between two wall panels.
Figure 12:
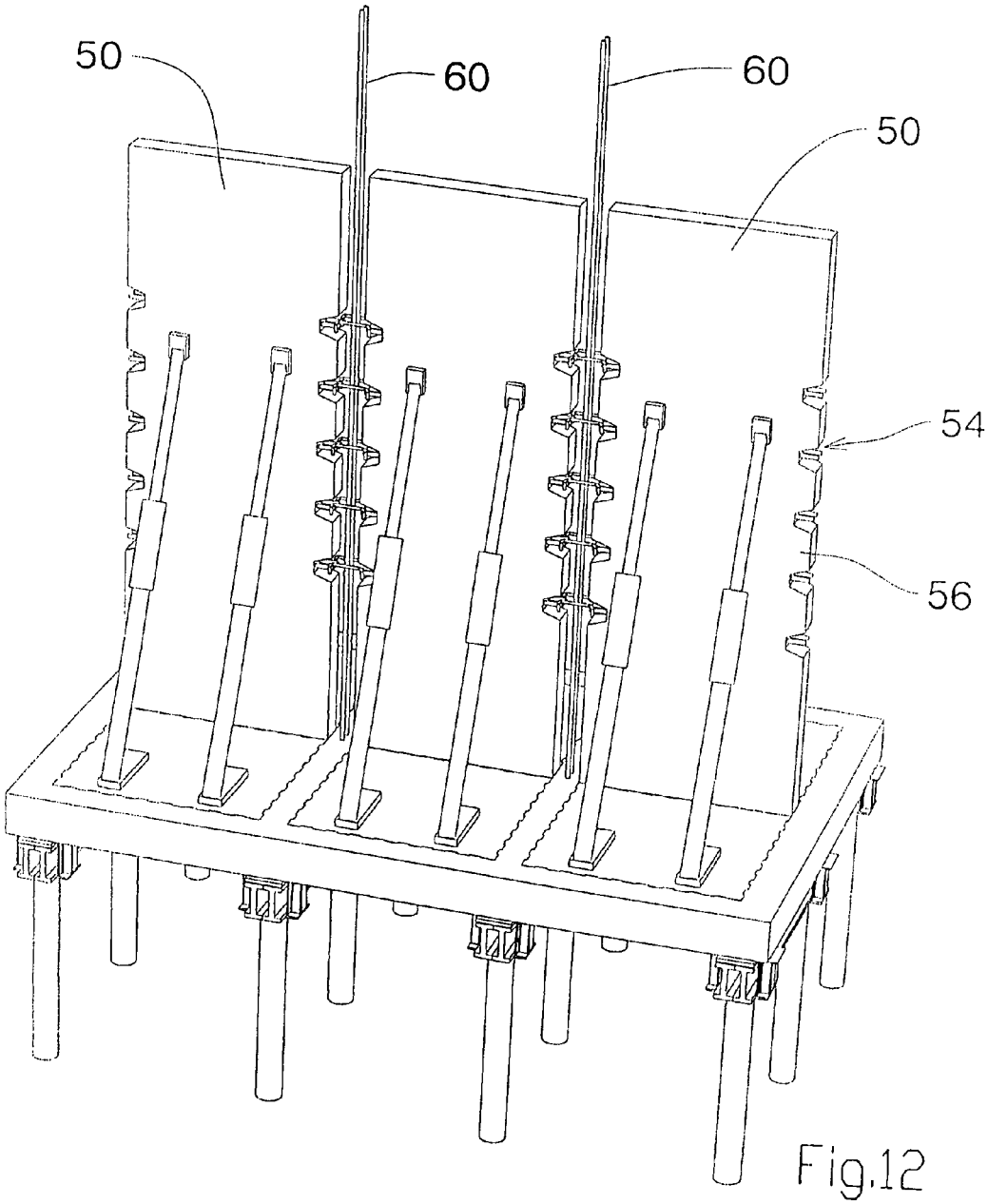
FIG. 12 is a perspective of the wall panels, showing insertion of rebars.
Figure 13:
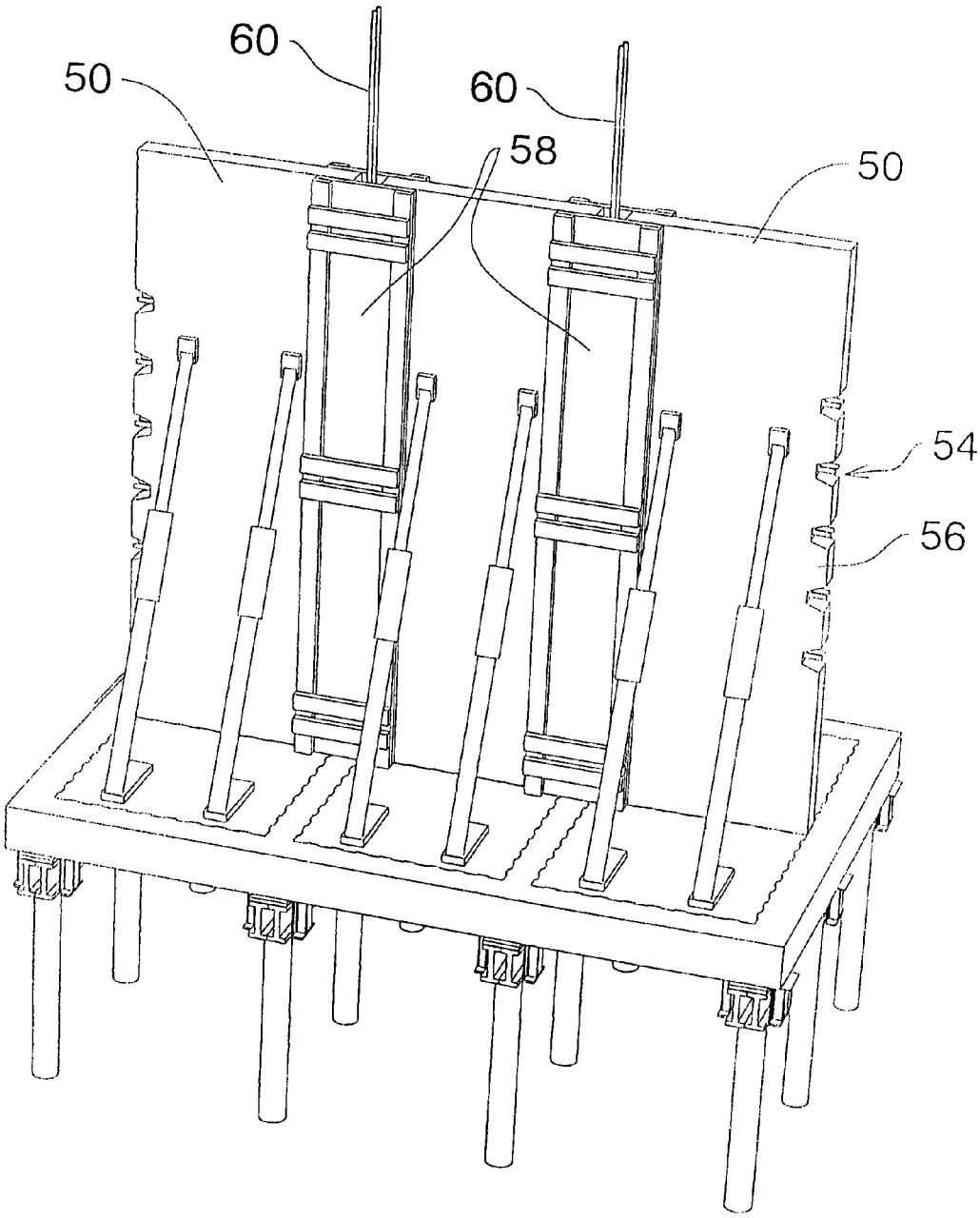
FIG. 13 is a perspective of the wall panels, showing the erection of formwork, prior to the pouring of a vertical concrete frame, between two wall panels.
Figure 14:
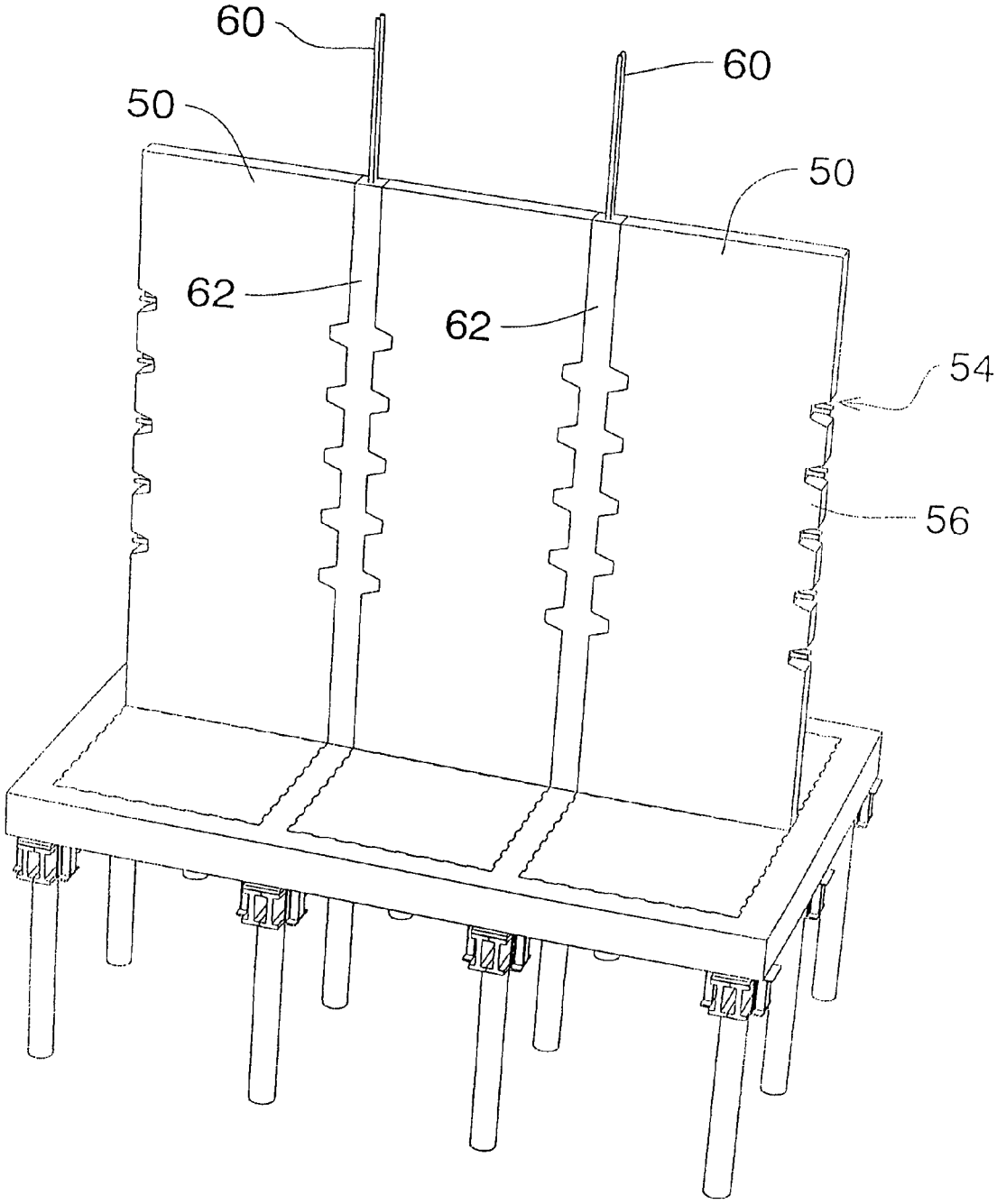
FIG. 14 is a perspective corresponding to FIGS. 11 and 12, after pouring of the concrete for the vertical frame s between the wall panels.
Figure 15:
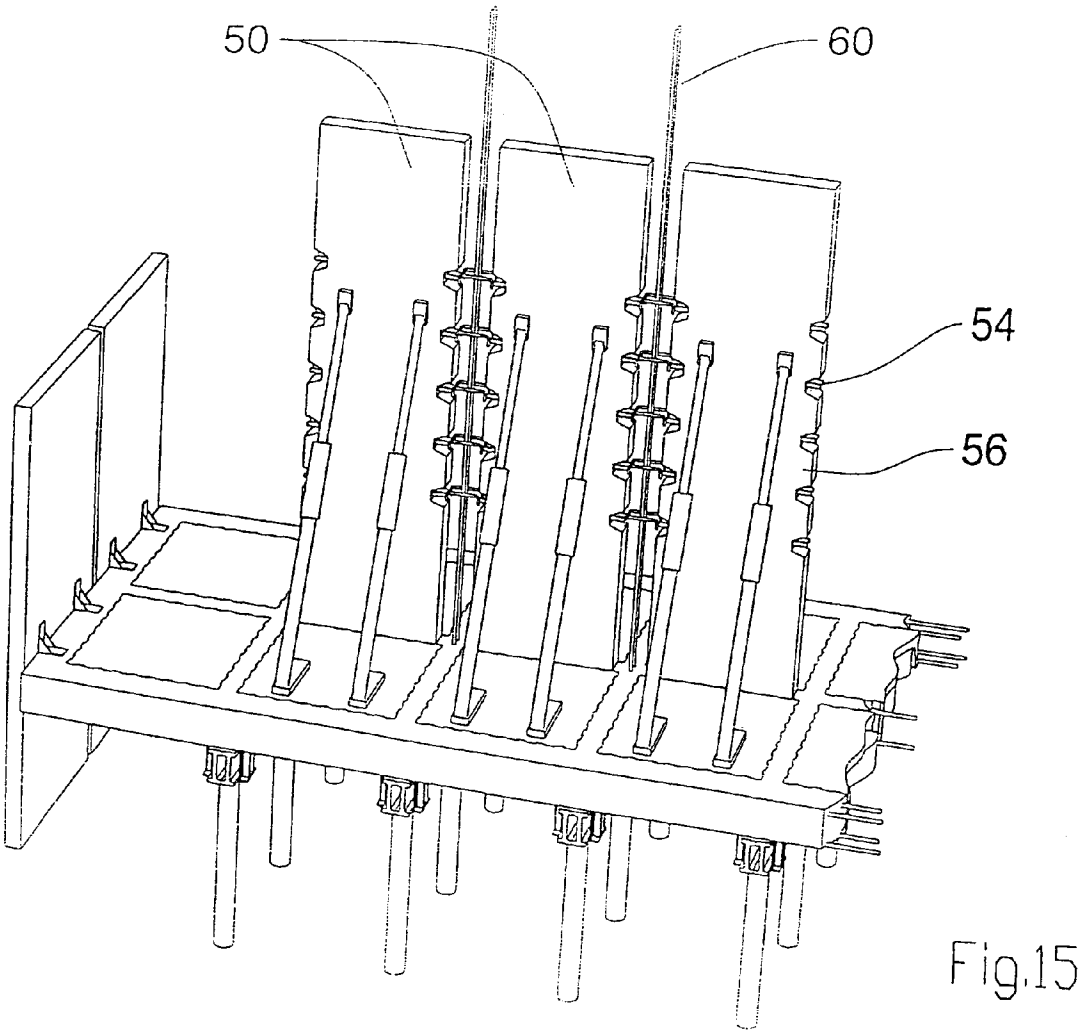
FIG. 15 is a schematic perspective showing a building under construction, with exterior wall panels, and with interior precast wall panels shown supported with their edges spaced apart and with vertical frame rebars located in said spaces.

FIG. 6 illustrates the same section after pouring-in-place of the concrete beam (16)

In Operation

The steps (FIGS. 7, 8, 9, and 10) of assembling the caissons (14), and forming the beams (16) require the erection of formwork strips (42).

The strips are supported on suitable construction equipment, such as I beams (44) and posts (46), such as are well known in the art.

The caissons (14) are then laid in position registering on the form work strips (42). These strips (42) will close off the spaces between the lower lips (28) of the side walls (24) of the adjacent caissons (14).

The channel rebars (40) are laid within the V-shaped trough or channel space (38). Concrete is then poured into the space (38) to fill it substantially level with the upper floor slab surface (18) of each of the caissons (14). In the process of filling such channel spaces (38), the concrete will flow round the buttresses (32) and into the locking spaces (34) defined by the two outer surfaces of the two adjacent caisson side walls (24) and will flow underneath the upper lips (30 of the side walls (24) of the adjacent caissons (14), and will thus make a good locking joint between the adjacent caissons.

The beams (16) will have a depth equal to the spacing between the upper floor surface (18) of the caissons (14) and the lower most surfaces of the lower lips (28). In this way, the beams (16) lock the caissons (14) in position will have depth equal to the dimension of the depth of side walls (24) of the caissons (14). Such beams (16), being reinforced with channel rebars (40) form a checker board network across the floor, holding the caissons (14) in position, and provides a floor of very great strength. At the same time, however such a floor will incorporate about between one half and one quarter of the volume of concrete required for a typical plain floor slab. In addition the dimensions of the rebars (36) in the caissons (14) are much less than the typical rebars used in a planar floor slab. Therefore each floor is lighter and uses less steel than a floor of conventional poured slab construction.

It will be seen that very great economies can be achieved by using the modular construction of the invention, with precast caissons (14) locked in place with poured-in-place beams (16), as compared with conventional planar floor slabs of conventional building techniques. It will also be seen that the amount of form work required for such a modular floor system is drastically less than the form work required for a complete poured-in-place floor slab. The form work (42) in fact consists only of a checker board formation of strip pieces of form work, for closing off the spacing between the lower lips (28) of adjacent caissons (14). In forming such a modular floor, it will of course be appreciated that the form work closing off the spacing between the lower lips (28) of the adjacent caissons (14) is supported by steel posts or posts (46) of conventional type.

The caissons (14) will be placed on the form work and supported on posts, such as are conventionally used in construction to support form work.

Preferably, in one embodiment of the invention, posts (46) are provided with upwardly directed generally U-shaped support brackets. Within the U-shaped support brackets, there are laid support beams (44). The checker board arrangement of form work strips will then be laid on top of those beams, as shown in the illustrations, FIGS. 7, 8, and 9. Once the modular floor of the invention is in place and cured, then exterior walls and/or partition walls or demising walls, as required. Preferably the interior demising walls are in the form of precast interior wall panels (50). Each precast wall panel (50) incorporates rebars in their construction. Rebar locking portions (52) extend outwardly from the side edges of such wall panels. The side edges are formed with notches (54) which define between them abutments (56), for reasons described below.

The wall panels (50) are then erected with their side edges spaced apart. Vertical form work (58) is then attached to the wall panels closing off the spacing, on either side. Frame rebars (60) may be placed in the spacing between the edges of the wall panels (50). Concrete is then poured down through the spacing between the edges, and the form work, to form vertical frame s (62) interconnecting the wall panels (50). The concrete forming the vertical frame s will flow into the notches and around the abutments, and will envelope the side edge rebars. This will provide wall frame s of great strength and they will bond integrally with the adjacent wall panels. Such interior walls and wall frame s will provide support fro each floor as the building progresses.

In order to form a perimeter beam around the caissons, side form work (64) will be erected and rebars will be placed there. This when the beams are poured around the caissons, the perimeter beam (66) will also be formed.

In a preferred embodiment of the invention, the caissons (14) typically have a dimension of between 1 and 1.5 meters in length and breadth, and typically being spaced apart by about 50 mm at their lower edges.

Where caissons are being installed at locations where interior vertical wall panels will be positioned, and where the vertical frame s (62) between the interior wall panels will be poured, then the caissons will usually be spaced apart a somewhat greater distance, about 150 to 200 mm, being the typical spacing at their lower edges.

Figure 16:
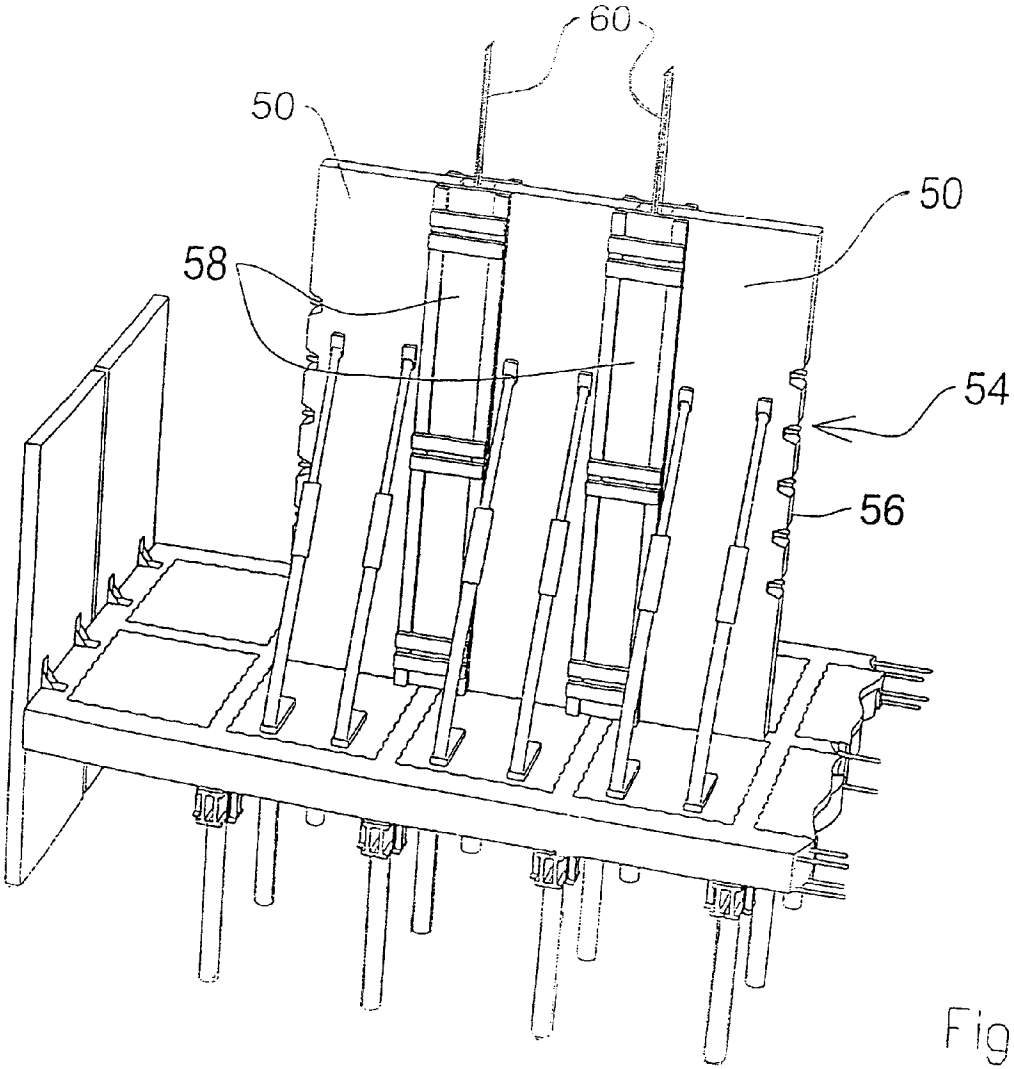
FIG. 16 is section of a floor beam, showing the erection of formwork and vertical rebars, where vertical wall panels are being installed.

Frame rebars (60), from the frame (62) formed between a pair of adjacent wall panels on the floor beneath, will extend up through the channel space (38) between the caissons (14) of the next superior floor, ie the floor being formed above the wall panels. These will usually extend up about 50 cms, above the level of the next superior floor, so as to provide overlap rebar portions (60A), (FIG. 16), to overlap with the rebars (60) of the next higher frame (62).

The exterior of the building, as explained above is covered in with any suitable exterior cladding such as panels. Typically the exterior will be formed by exterior precast concrete panels (68), which are supported in any suitable manner on the perimeter beams (66), such as by metal brackets.

Figure 17:
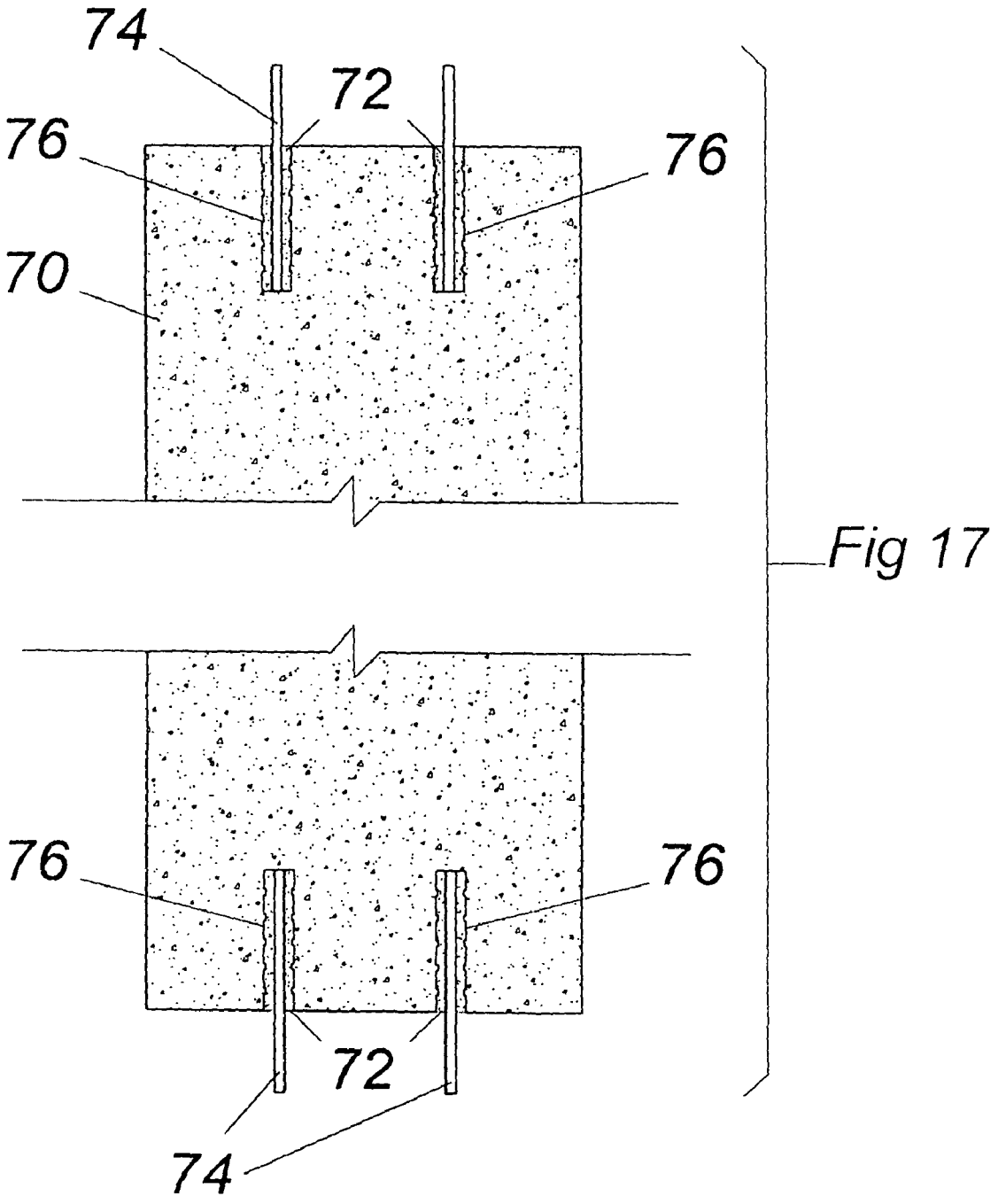
FIG. 17 is a schematic section of a building column.
Figure 18:
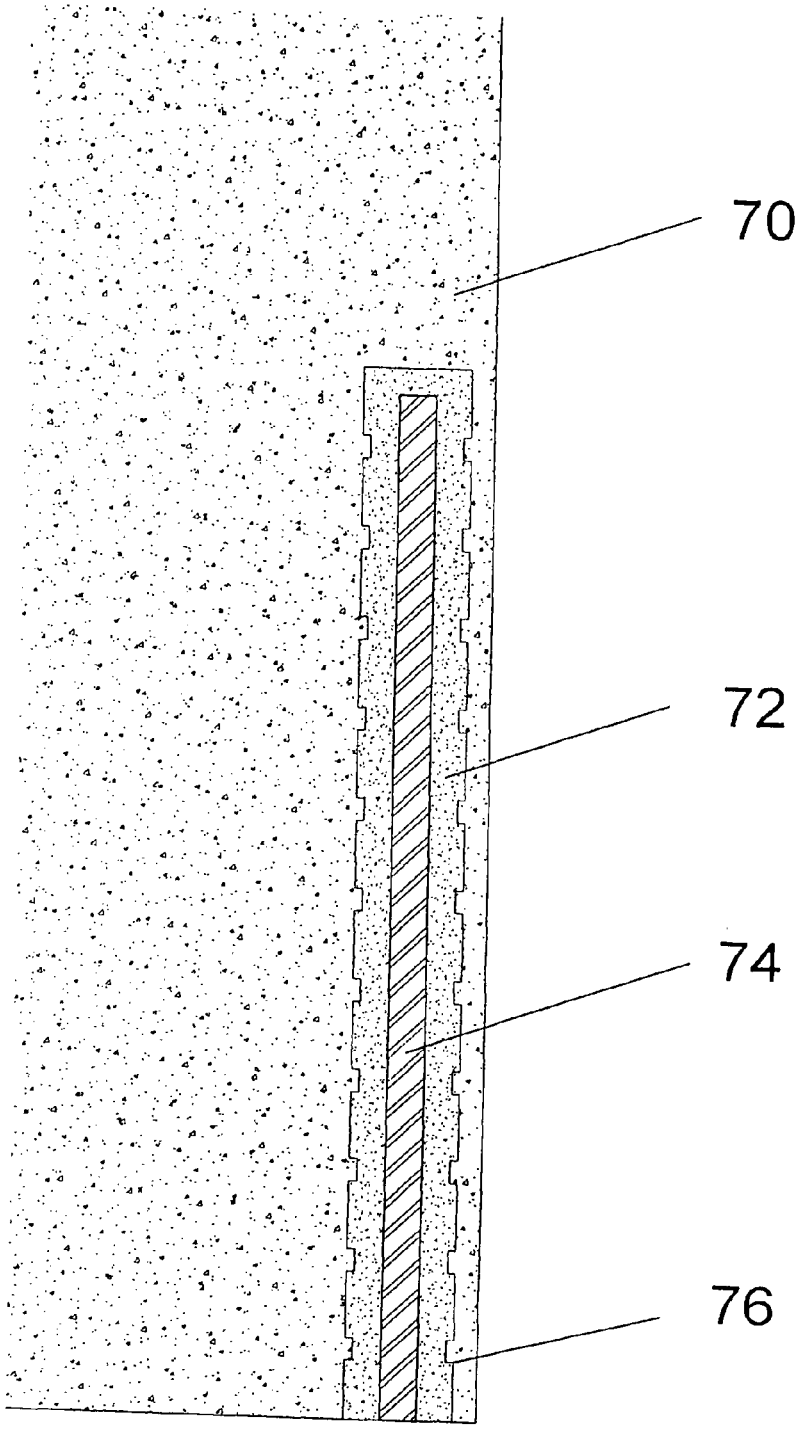
FIG. 18 is an enlarged section showing the insertion of one rebar into a column.
Figure 19:
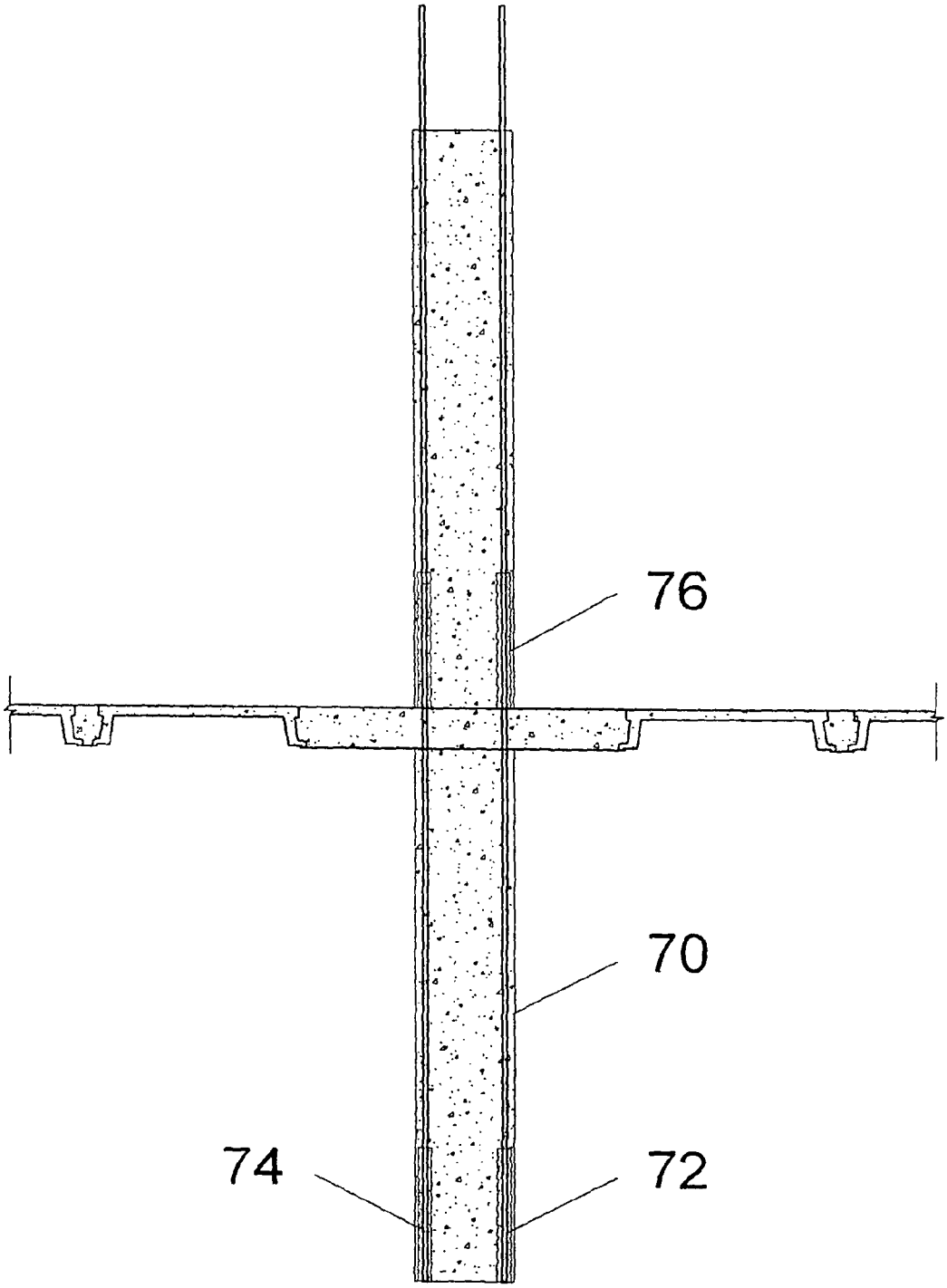
FIG. 19 is a schematic section, showing the interconnection of such a column with the caissons and supporting beams
Figure 20:
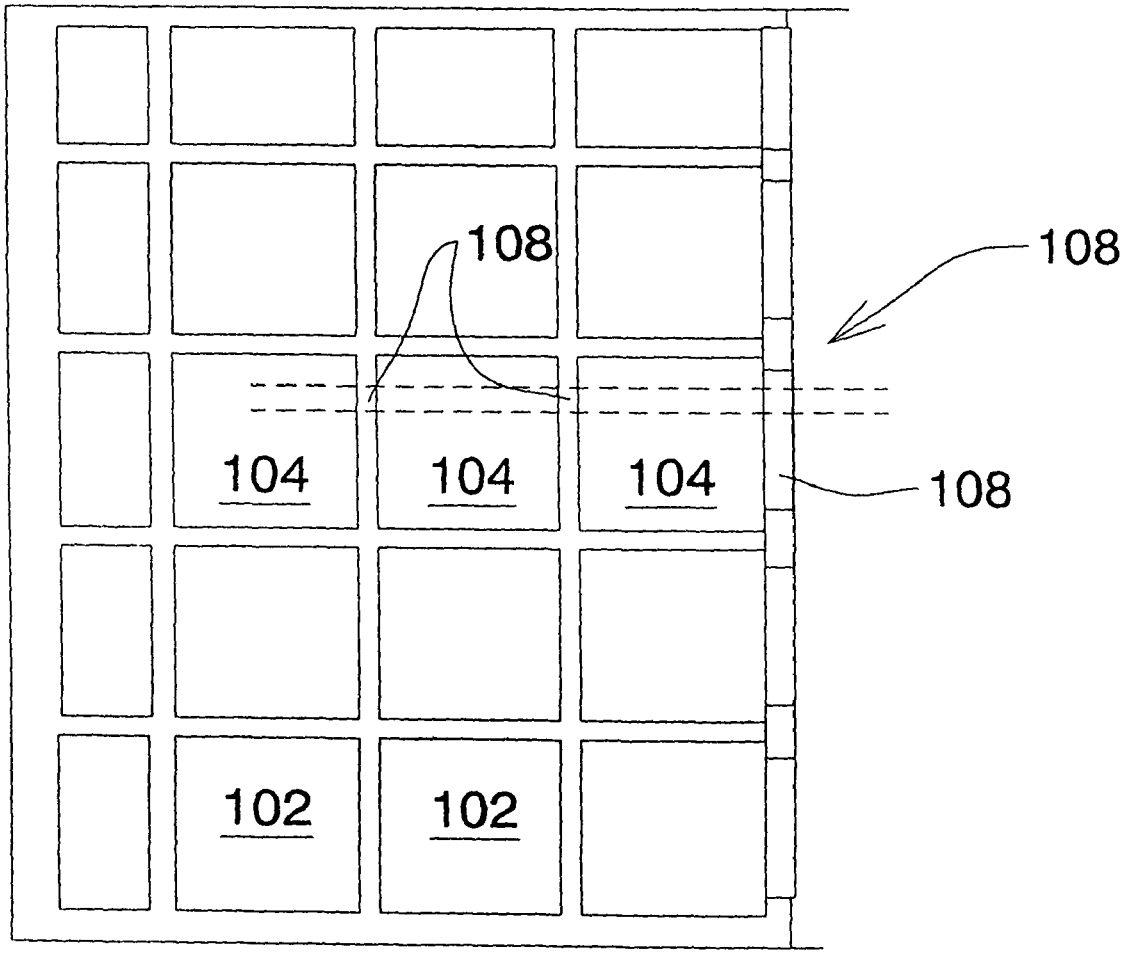
FIG. 20 is a plan view of an alternate form of floor, showing some floor portions being formed of plain flat panels, and showing services in phantom.
Figure 21:
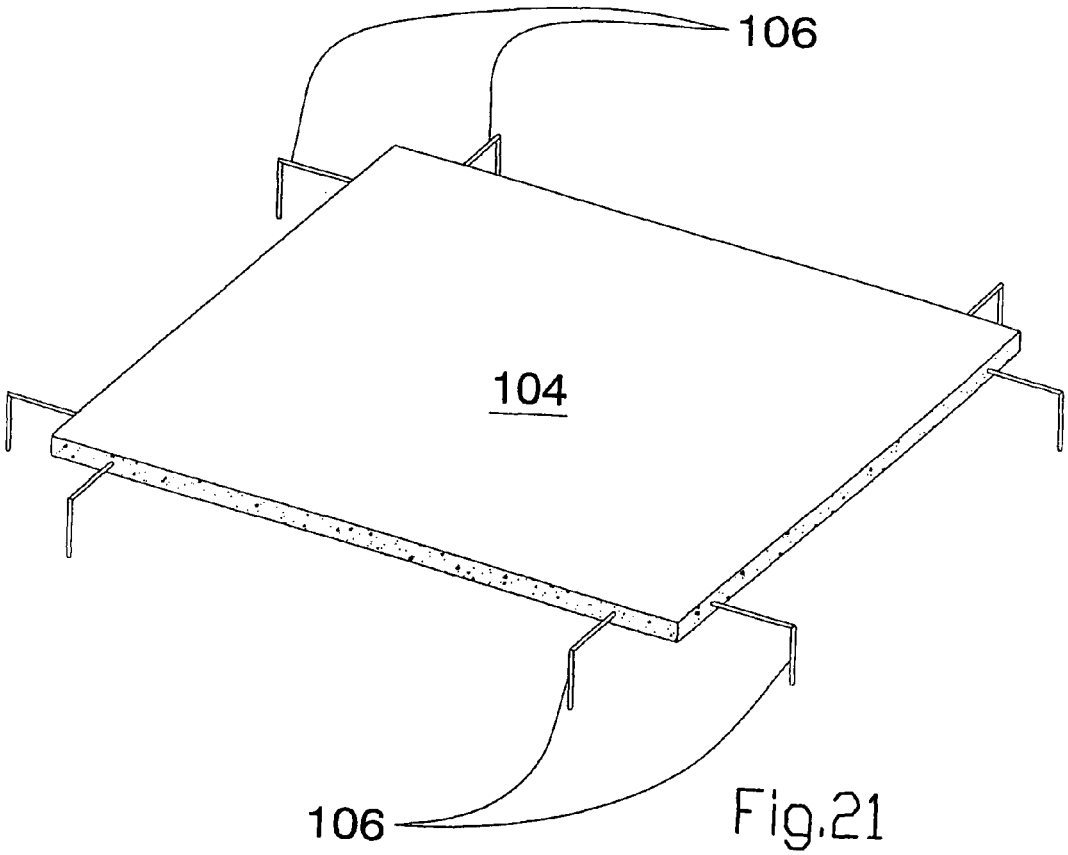
FIG. 21 is a perspective of a plain flat panel, showing rebars extending from is edges.

It will be appreciated that the building will also incorporate the usual number of support columns. One form of support column (70) is shown in FIG. 17.

Such a column is a precast structure, and is formed with upper and lower rebar sockets (72) receiving rebars (74). The sockets are filled with premix cement or fine concrete to lock the rebars in place. The sockets may be formed with internal abutments (76) to lock with the premix. Typically the abutments will be in the form of coarse spiral threads, which are formed during precasting.

The system will allow the rebars to be passed up through the beam channels and embedded in the poured in place beam.

The entire system can be used for high rise construction of multiple floor buildings, or for low rise construction, and can also be applied to the erection of individual homes.

In all these cases the system offers great advantages over current construction, and avoids the use of much of the wood, and of metal framing, in the actual construction, and also greatly reduces the volumes of concrete, and of rebars, and the time and materials required for erecting form work on site, pouring concrete, curing time for the concrete, and dismantling of the form work.

In some locations in a building it may be desirable to use plain flat precast panels instead of caissons. These may be arranged to form part or all of a floor, or successive floors of a building.

Such construction is shown in FIGS. 20, 21, 22, and 23.

In these cases a floor (100), may comprise some areas of caissons (102), in some parts, and plain flat floor panels (104) in The flat panels (104) having upper and lower surfaces will be precast (FIG. 21) with rebars (106) extending out around their sides. Such rebars (106) will be bent ie at right angles. The panels (104) will have edges which define upper and lower sides with panel side walls (105) extending therebetween. The flat floor panels (104) will be supported and arranged in a checkerboard fashion similar to FIGS. 1 and 2.

Channel rebars (107) will also be placed in the trough shaped floor beam forms, similar to the channel rebars above. The channel rebars (107) and the edge rebars (106) of the floor panels will thus be embedded together in the floor beams when concrete is poured into the trough forms.

Figure 22:
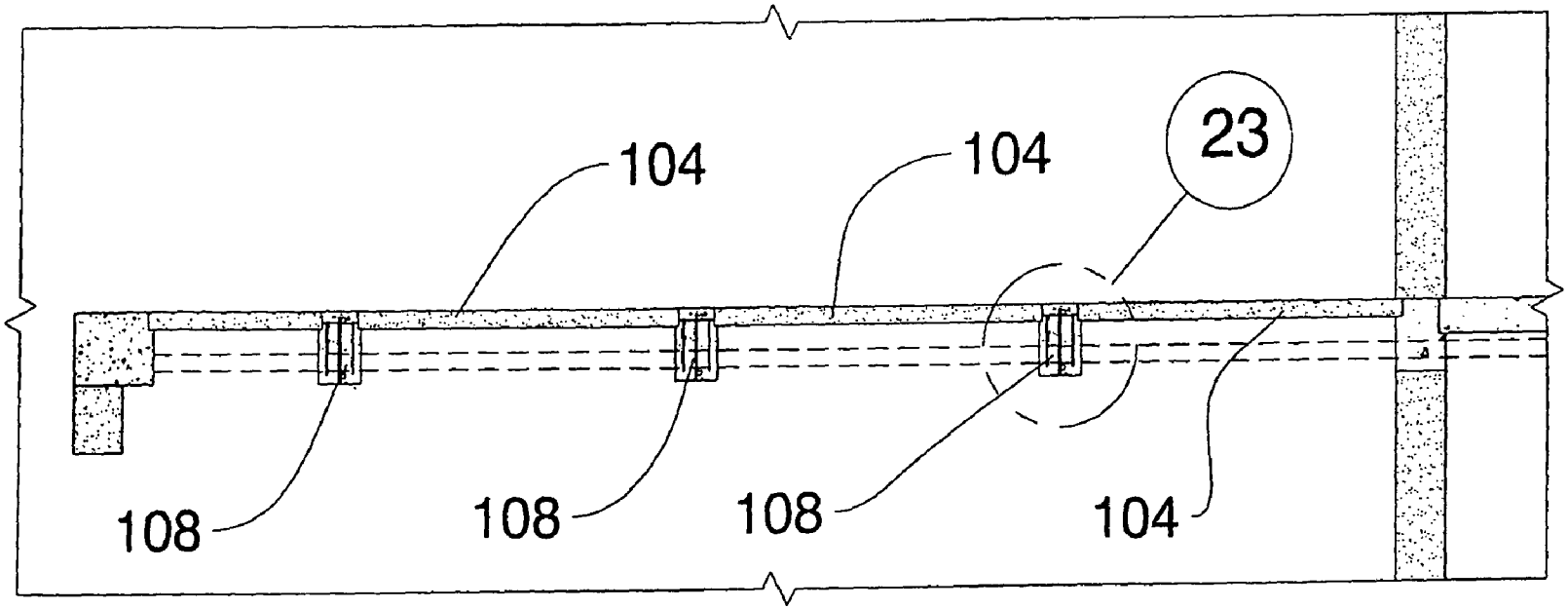
FIG. 22 is a section along line 22-22 of FIG. 20 showing beams supporting two plain flat panels, and with services shown in phantom, and, FIG. 23 is an enlarged section of one beam from FIG. 22.
Figure 23:
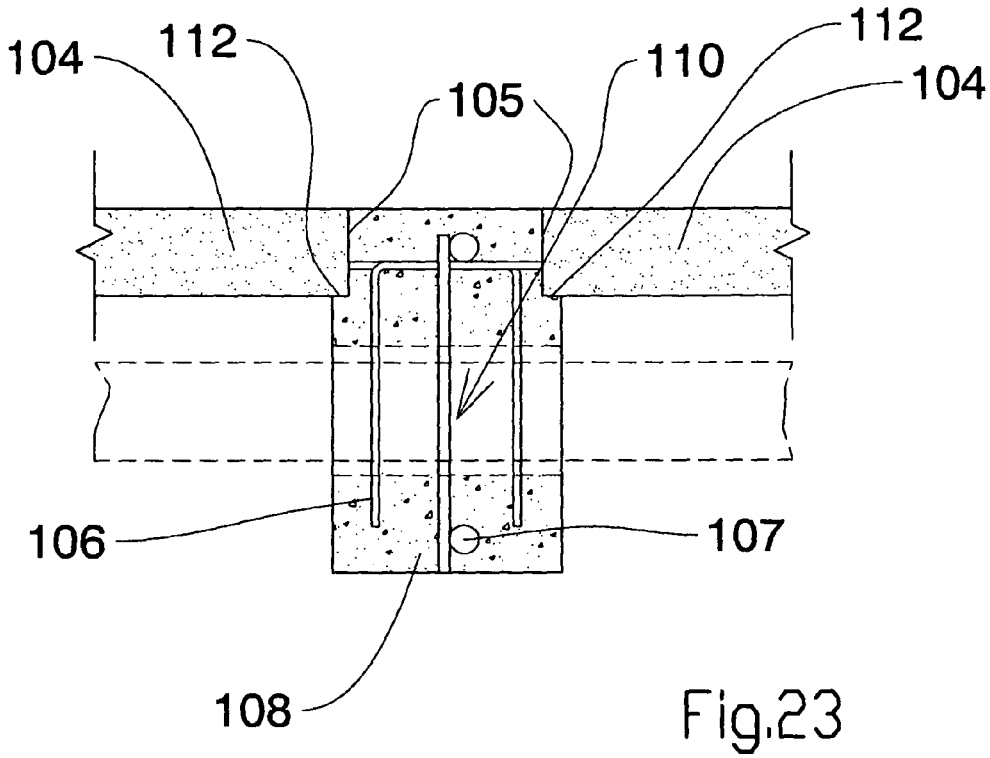

When forming the floor, the form work in the regions of the flat floor panels (104) will incorporate trough shaped beam forms of three sided rectangular shape, located beneath the undersurfaces of the floor panels (104) so as to produce beams (108) FIGS. 22 and 23. The lower portions of the floor beams are formed with ledges (112) which define a width wider than the spacing between the side walls of the flat panels (104) FIG. 23) so as to underlie and support the edges of panels (104) and thus provide a rigid support for the flat panels (104).

Pre cast wall panels (50) will be placed along the floor beams, with spacing between their sides. Concrete is poured in this spacing, as before, to form a solid homogenous wall Structure. There will also be form work posts (not shown) supporting the flat floor panels (104). The edge rebars (106) extending from the flat floor panels (104) will be located in the trough formwork. Thus when the concrete for the beams (108) are poured in place, the concrete forming the beams (108) will flow around and embed the rebars (106) extending from the flat floor panels (104).

The pouring of beams (108) which support the flat floor panels (104) enables the introduction of services passing through such beams (108), beneath the floor panels. To facilitate this, through openings (110) may be formed transversely such beams (108). Such through openings (110) may be formed by simply placing hollow tubes lying transversely in the trough formwork. Such tubes may for example be plastic or metal pipe.

The concrete forming the beams, beams (108) when poured, will flow down into the troughs and outwardly under the edges of the panels and will define ledges (112) thereal-ong. Such ledges function to support the edges of the adjacent floor panels.

When completed the combination of floor panels, floor beams, vertical columns , and wall panels , all of which are securely bound together by respective interlocking rebars extending from the respective panels into the beams, and columns forms a rigid box-like structure of great strength and rigidity. The same advantages are also achieved by the combination of caissons and beams and wall panels, all being bound together by rebars embedded in the beams, as described above.

The box-like configuration is illustrated generallywith reference to FIG. 24, which shows a schematic partial section arrangement of lower and upper floor panels, and floor beams, and vertical columns and wall panels and frames forming a four sided box-like construction.

At the same time construction time is reduced, and volumes of concrete and steel are reduced, thereby reducing the overall cost of construction, and speeding up completion.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A method of forming a building having a series of floors one above the other at least partially from modular pre cast concrete components and comprising the steps of;

precasting a plurality of concrete floor panels, each said floor panel being formed with a planar floor on its upper surface and with side walls depending downwardly from the plane of said floor, and defining undersurfaces, and having rebars in said planar floor panels and edge rebar portions extending from said side walls;

erecting form work troughs on supports at a work site for supporting said floor panels;

placing said floor panels above and lying on said form work troughs at said work site, said floor panels being spaced apart and defining beam channel spaces between floor panel side walls of adjacent floor panels;

placing beam rebars in said beam channel spaces;

placing vertical rebar junction portions in said channel spaces;

pouring concrete in said beam channel spaces, said concrete flowing downwardly therethrough into said form work troughs to form poured in place beams extending between and under said floor panels, said beams embedding said beam rebar, said floor panel edge rebar portions, and said vertical rebar junction portions; and, installing precast vertical columns said columns defining upper and lower ends, said columns having rebar sockets formed in said upper and lower ends with said vertical rebar junction portions received in said sockets at said lower end of each said vertical column.

2. A method of constructing a building at least partially from precast components, as claimed in claim 1, and including the further step of precasting a plurality of solid concrete vertical wall panels defining wall edges and spacing said wall panels along said beams with their wall edges spaced apart to define vertical frame spaces therebetween.

3. A method of constructing a building at least partially from precast components, as claimed in claim 2, and including the steps of erecting form work strips against said wall panels registering with said vertical frame spaces , and pouring concrete between said wall edges of said wall panels to form vertical concrete frames.

4. A method of constructing a building at least partially from precast components, as claimed in claim 1, and including the steps of forming transverse through openings through said poured in place floor beams, said openings being adapted to receive services therethrough.

5. A modular pre cast concrete construction system comprising:

a plurality of pre cast concrete floor panels, each panel defining a planar floor portion;

lower and upper floor panel edges defined on said panels, and defining panel side walls there between;

panel rebars located in said planar floor panels;

floor panel edge rebar portions extending outwardly from said floor panel side walls between said upper and lower edges;

said floor panels being located as a floor in a checker board fashion with floor beam spaces defined between adjacent floor panels, groups of said floor panels being arranged as successive floors one above another spaced vertically apart to define a plurality of floors;

poured in place horizontal concrete floor beams formed in said floor beam spaces between adjacent panel side walls, and defining lower floor beam portions beneath said floor panels, said lower floor beam portions beneath said floor panels having a width greater than the width of said floor beam channels and supporting adjacent edges of said floor panels;

floor beam rebars located in said floor beam spaces, said floor beam rebars and said floor panel edge rebar portions extending from said floor panels being embedded in said concrete beams;

a plurality of precast concrete vertical columns, each said vertical column containing rebars and defining upper and lower ends, said vertical columns being arranged one above the other in vertical alignment with one another;

vertical junction rebar portions extending between said vertical columns in vertical alignment;

vertical junction rebar sockets formed in said upper and said lower ends of said vertical columns for receiving said junction rebar portions and connecting next adjacent vertical columns in vertical alignment;

a plurality of precast concrete wall panels, each of said wall panels defining wall panel side edge walls and wall panel upper and lower edge walls, and defining a predetermined wall thickness, groups of said wall panels being located on successive said floors and extending from one said floor to a next adjacent said floor;

rebars embedded in said wall panels, and having wall edge rebar portions extending from either side edge wall and from said top wall;

said wall panels being located in vertical planes edge to edge with wall column spaces between said wall panel edges;

poured in place concrete wall columns, between adjacent side walls of said wall panels, wall column rebars located in said poured in place concrete wall columns, said wall column rebars embedding said side edge rebars extending from adjacent said wall panels embedded in said wall columns.

6. A modular pre cast concrete construction system as claimed in claim 5 wherein said vertical rebar portions are embedded in said floor beams and extend therefrom both downwardly and upwardly.

7. A modular pre cast concrete construction system as claimed in claim 6 wherein said vertical rebar portions are secured in said rebar sockets by concrete located in said sockets and surrounding said vertical rebar portions.

8. A modular pre cast concrete construction system as claimed in claim 7 wherein said sockets are formed with internal abutments engaging with said concrete in said sockets.

9. A modular pre cast concrete construction system as claimed in claim 5 wherein said floor beams define upper beam portions located between said side walls of said floor panels, and under beam portions located beneath said floor panels, and wherein said upper beam portions define a width equal to the spacing between said side walls of said floor panels, and wherein said lower beam portions define a width greater than said spacing between said side walls of said floor panels, and further define beam edge portions underlying edges of adjacent floor beams.

10. A modular pre cast concrete construction system as claimed in claim 9 including transverse openings formed through said beam under portions for receiving building services therethrough.

11. A modular pre cast concrete construction system as claimed in claim 10 including notches formed in said side edges of said wall panels, and said edge rebar portions extending into said notches, said notches defining side edge abutments therebetween.

* * * * *

UNITED STATES PATENT AND TRADEMARK OFFICE

CERTIFICATE OF CORRECTION

PATENT NO. : 8,336,276 B2
APPLICATION NO. : 13/064826
DATED : December 25, 2012
INVENTOR(S) : Nikolay P. Tikhovskiy It is certified that error appears in the above-identified patent and that said Letters Patent is hereby corrected as shown below:

In the claims

Claim 5, column 11, line 13 replace the words “column rebars” with the word “COLUMNS”

Signed and Sealed this
Twenty-ninth Day of October, 2013

Teresa Stanek Rea
*Deputy Director of the United States Patent and Trademark Office*